US007401992B1

(12) United States Patent
Lin

(10) Patent No.: US 7,401,992 B1
(45) Date of Patent: Jul. 22, 2008

(54) WRITING INSTRUMENT

(76) Inventor: Wei-Jong Lin, 6F-11, No. 8, Sec. 1, Jhongsing Rd., Wugu Hsiang, Taipei Hsien (TW)

( * ) Notice: Subject to any disclaimer, the term of this patent is extended or adjusted under 35 U.S.C. 154(b) by 0 days.

(21) Appl. No.: 11/801,148

(22) Filed: May 9, 2007

(51) Int. Cl.
*B43K 29/00* (2006.01)
*B43K 23/02* (2006.01)

(52) U.S. Cl. ..... 401/195; 401/131

(58) Field of Classification Search ..... 401/195, 401/52, 131
See application file for complete search history.

(56) References Cited

U.S. PATENT DOCUMENTS 6,773,192 B1 * 8/2004 Chao ..... 401/195
6,932,276 B1 * 8/2005 Liu ..... 236/486
7,029,193 B1 * 4/2006 Chao ..... 401/195

* cited by examiner

*Primary Examiner*—David J Walczak
(74) *Attorney, Agent, or Firm*—William E. Pelton, Esq.; Cooper & Dunham LLP

(57) ABSTRACT

A writing instrument has a barrel, a connector and a clip. The barrel has a front end, a rear end and a writing tip. The writing tip is mounted on the first end. The connector is mounted on the barrel. The clip attaches to the connector and has an inner surface, an outer surface, a proximal end, a distal end, a cavity, memory and an input and output (I/O) interface. The memory is mounted in the cavity and stores data. The I/O interface is connected electronically to the memory and protrudes from the distal end of the connector. A user can bring the writing instrument to write or store date in the memory. Therefore, storing date and writing is combined in a small volume in the writing instrument.

17 Claims, 14 Drawing Sheets

WRITING INSTRUMENT

BACKGROUND OF THE INVENTION

1. Field of the Invention

The present invention relates to a writing instrument, and especially a writing instrument with a clip that has a memory device to store data.

2. Description of the Related Art

With modern developments in technology, more and more information is stored in memory devices instead of being written down on paper. Furthermore, the memory devices are becoming smaller and smaller. Therefore, the memory device is easily portable. However, bringing a pen and the memory device in one's bag is not convenient and adds to clutter in the bag. Therefore, the memory device also can be combined with a writing tool. A conventional pen has a barrel and a memory device. The barrel has a front end, a rear end, a space and a writing tip. The space is defined in the barrel. The writing tip is mounted on the front end. The memory device is mounted in the space in the barrel so people can use the pen to write and the memory device to store data. However, the barrel has to be larger to hold the memory. Therefore, bringing the pen is not convenience.

SUMMARY OF THE INVENTION

The objective of the present invention is to provide a writing instrument with a clip that has a memory device to store data.

To achieve the foregoing objective, a writing instrument in accordance with the present invention has a barrel, a connector and a clip. The barrel has a front end, a rear end, and a writing tip. The writing tip is mounted on the front end. The connector is mounted on the barrel. The clip attaches to the connector and has an inner surface, an outer surface, a proximal end, a distal end, a cavity, memory and an input and output (I/O) interface. The memory is mounted in the cavity and stores data. The I/O interface is connected electronically to the memory and protrudes from the distal end of the connector. A user can bring the writing instrument to write or store data in the memory. Therefore, storing data and writing is combined in a small volume in the writing instrument.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
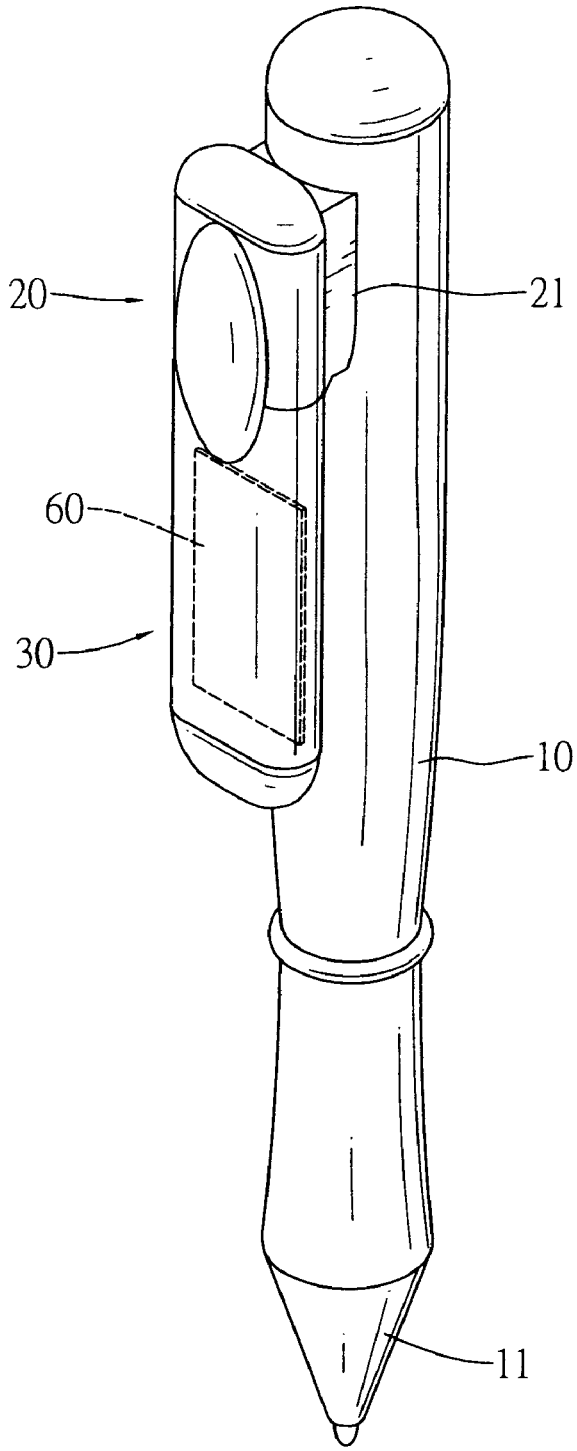
FIG. 1 is a perspective view of a first embodiment of a writing instrument in accordance with the present invention.

With reference to FIGS. 1, 4, 6, 9, 11 and 12, a writing instrument in accordance with the present invention comprises a barrel (10, 10*a*, 10*b*, 10*c*, 10*d*), a cap (40), a connector (20, 20*a*, 20*b*, 20*c*, 20*d*), a clip (30, 30*a*, 30*b*, 30*c*, 30*d*) and a laser pointer (50).

Figure 10:
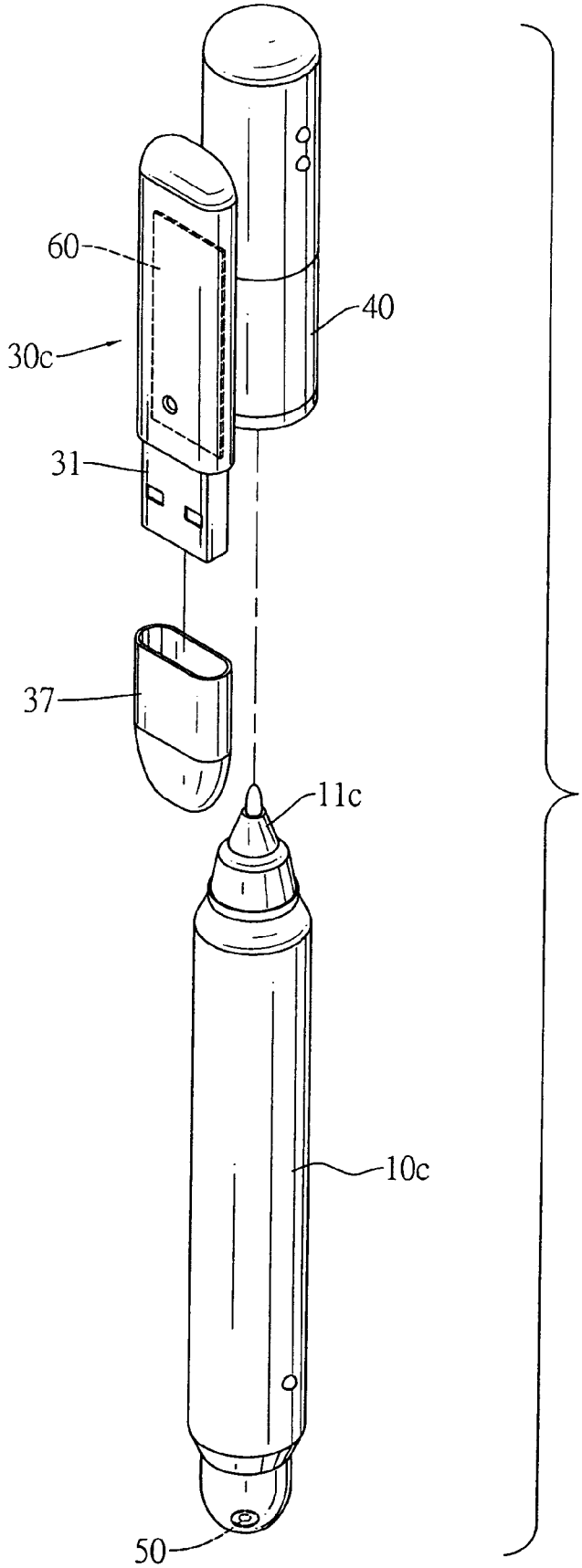
FIG. 10 is a partially exploded perspective view of the writing instrument in FIG. 9.
Figure 11:
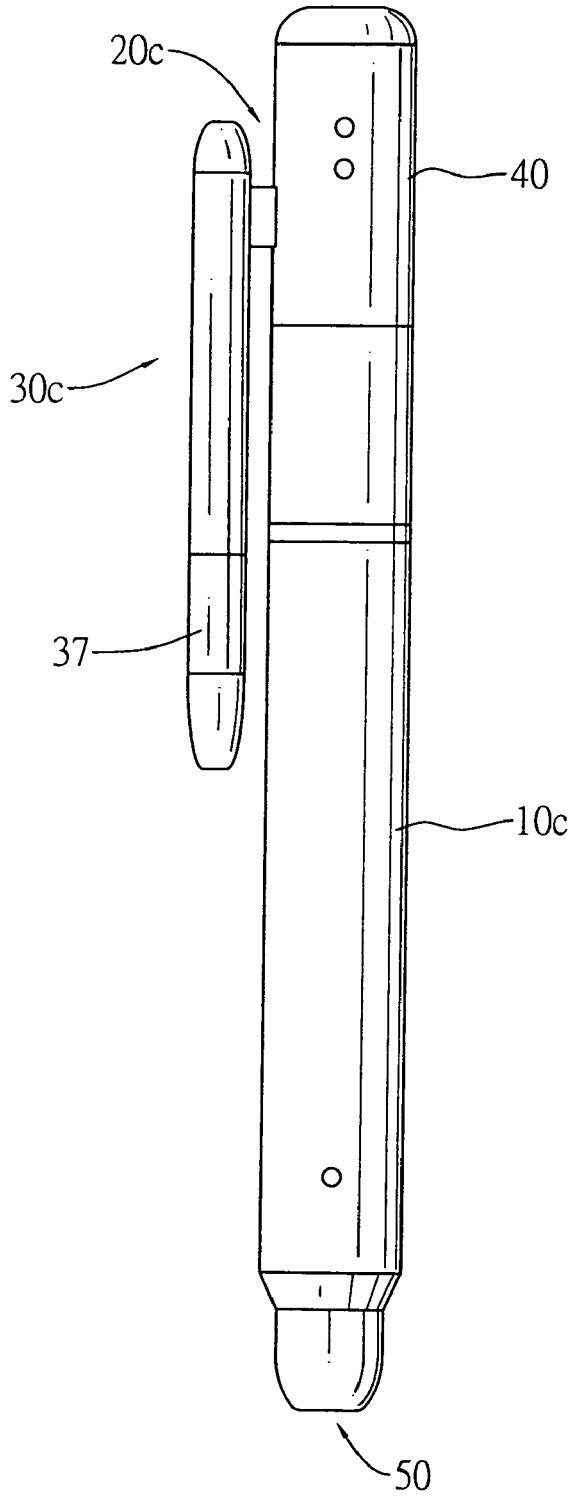
FIG. 11 is a side view of the writing instrument in FIG. 9.
Figure 12:
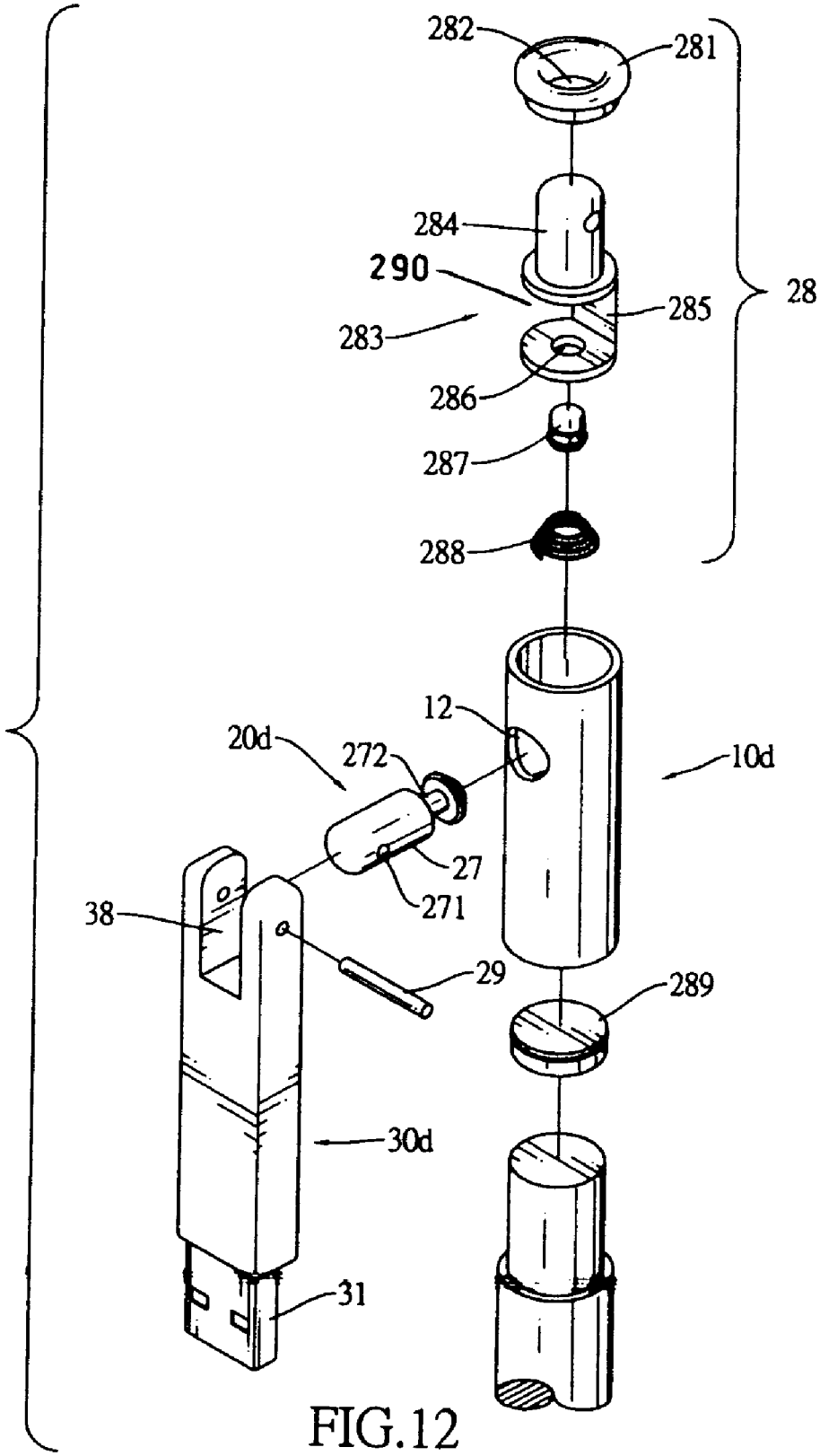
FIG. 12 is a partially exploded perspective view of a fifth embodiment of the writing instrument in accordance with the present invention.
Figure 13:
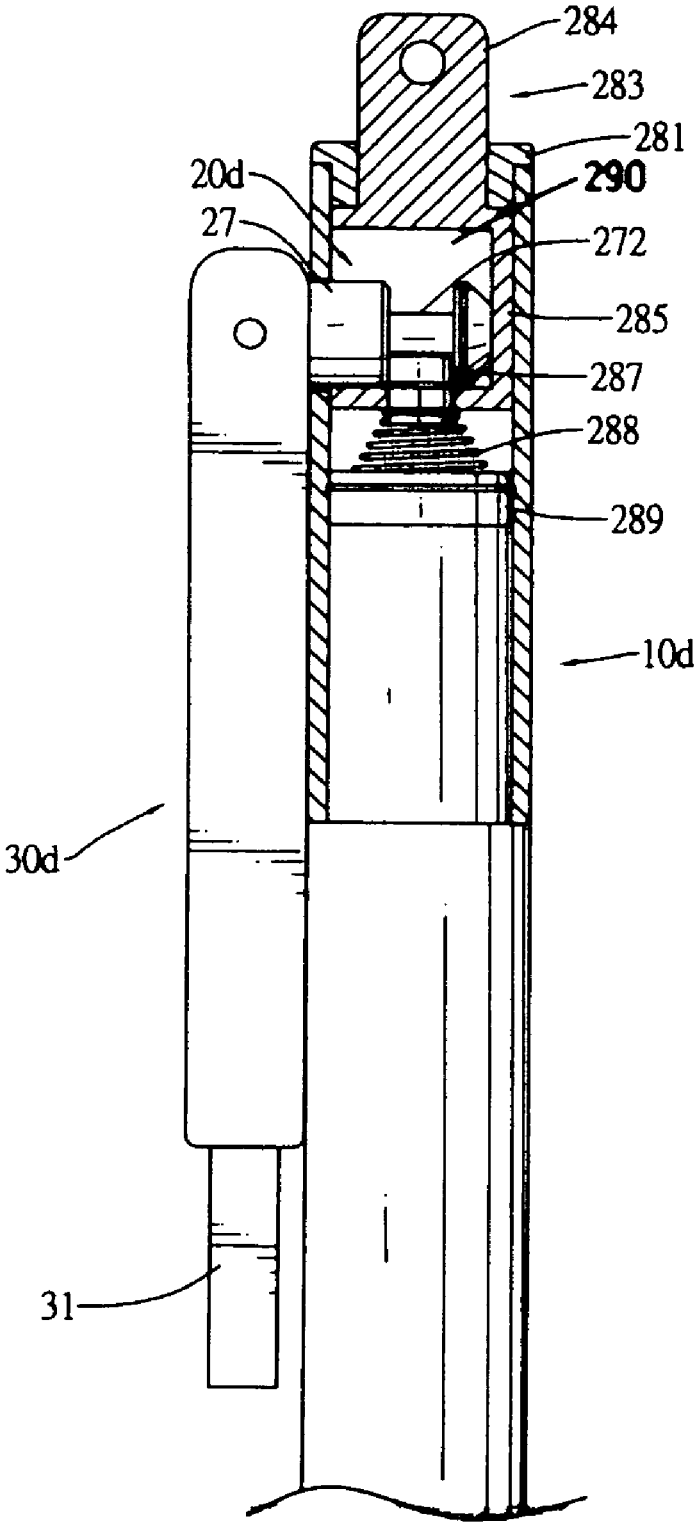
FIG. 13 is a side view in partial section of the writing instrument in FIG. 12.

With further reference to FIG. 10, the barrel (10, 10*a*, 10*b*, 10*c*, 10*d*) comprises a front end, a rear end, an outer surface and a writing tip (11, 11*a*, 11*b*, 11*c*). The writing tip (11, 11*a*, 11*b*, 11*c*) is mounted on the front end. With further reference to FIG. 12, the barrel (10*d*) on a fifth embodiment of the writing instrument further comprises a through hole (12). The through hole (12) is defined on the barrel (10*d*) adjacent to the rear end of the barrel (10*d*).

The cap (40) selectively covers the writing tip (11*c*) and connects detachably to the front end of the barrel (10*c*).

In a first, second and third embodiment of the writing instrument in accordance with the present invention, the connector (20, 20*a*, 20*b*) is attached securely to the outer surface of the barrel (10, 10*a*, 10*b*).

Figure 2:
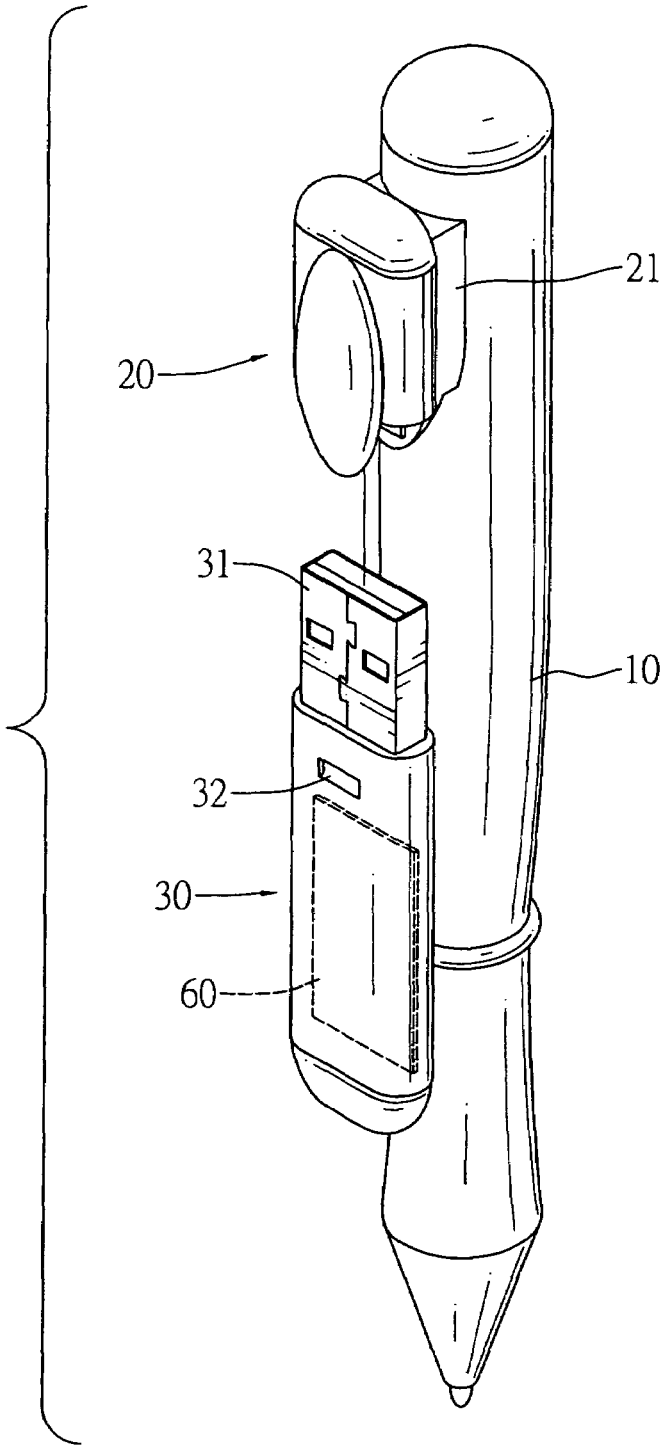
FIG. 2 is a partially exploded perspective view of the writing instrument in FIG. 1.
Figure 3:
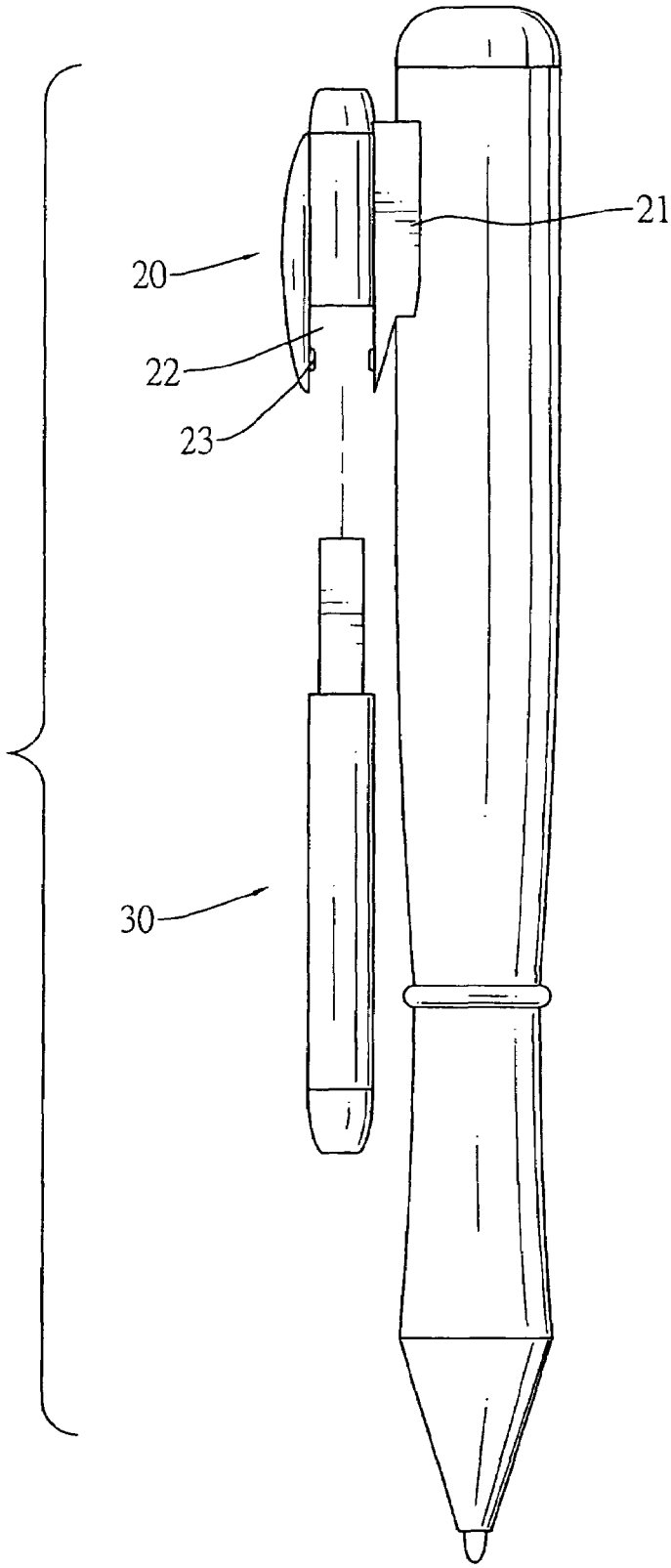
FIG. 3 is a partially exploded side view of the writing instrument in FIG. 1.
Figure 4:
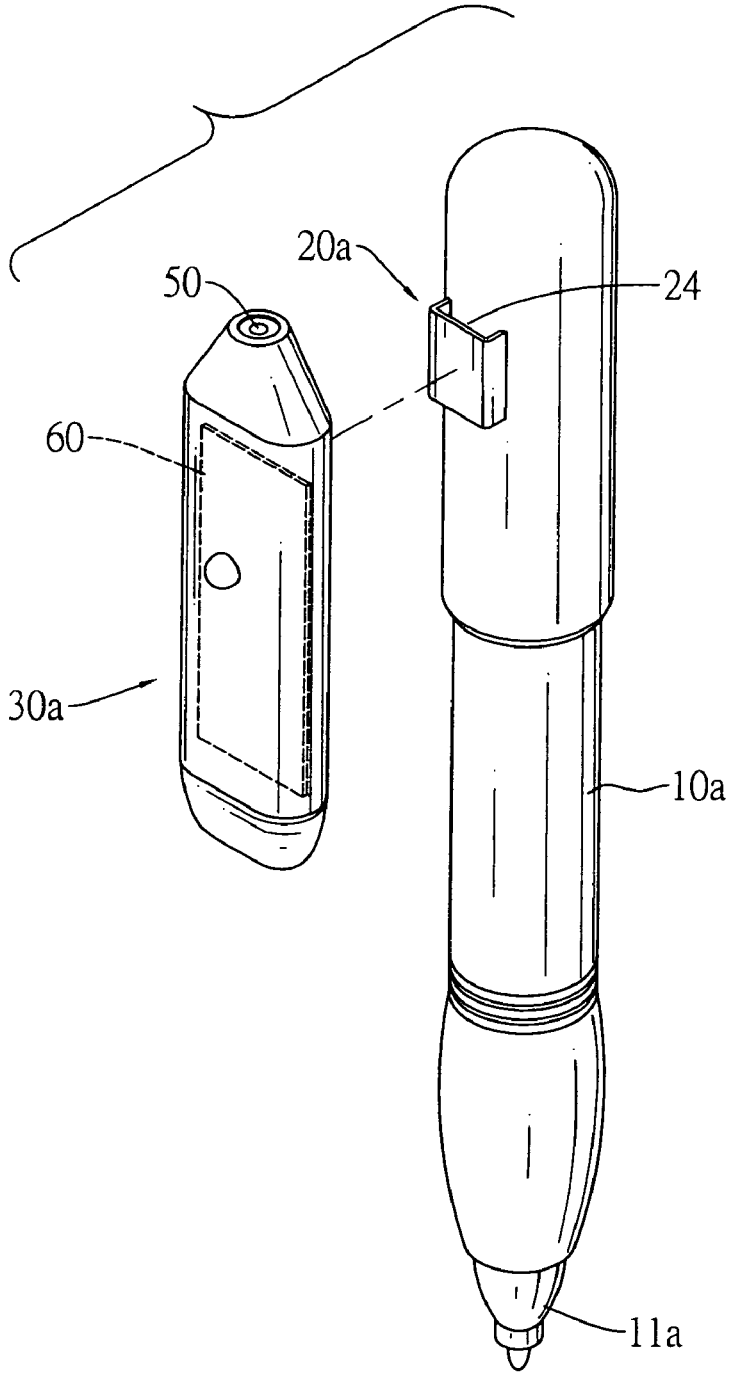
FIG. 4 is a partially exploded perspective view of a second embodiment of the writing instrument in accordance with the present invention.

With further reference to FIGS. 2 and 3, the connector (20) on the first embodiment of the writing instrument comprises a base (21) and a mounting recess (22). The base (21) is attached securely to the outer surface of the barrel (10) and has a bottom surface. The mounting recess (22) is defined in the bottom surface and has an inner surface and two protrusions (23). The protrusions (23) are formed on and protrude from the bottom surface flush with the inner surface of the mounting recess (22) and parallel to each other.

Figure 5:
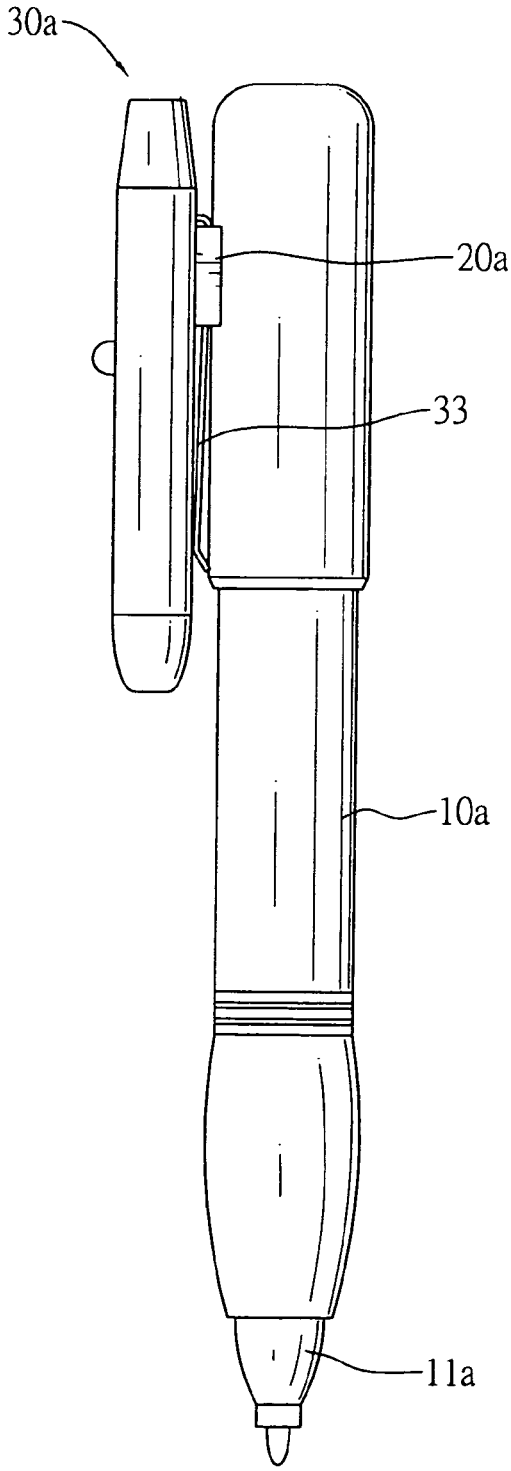
FIG. 5 is a side view of the writing instrument in FIG. 4.
Figure 6:
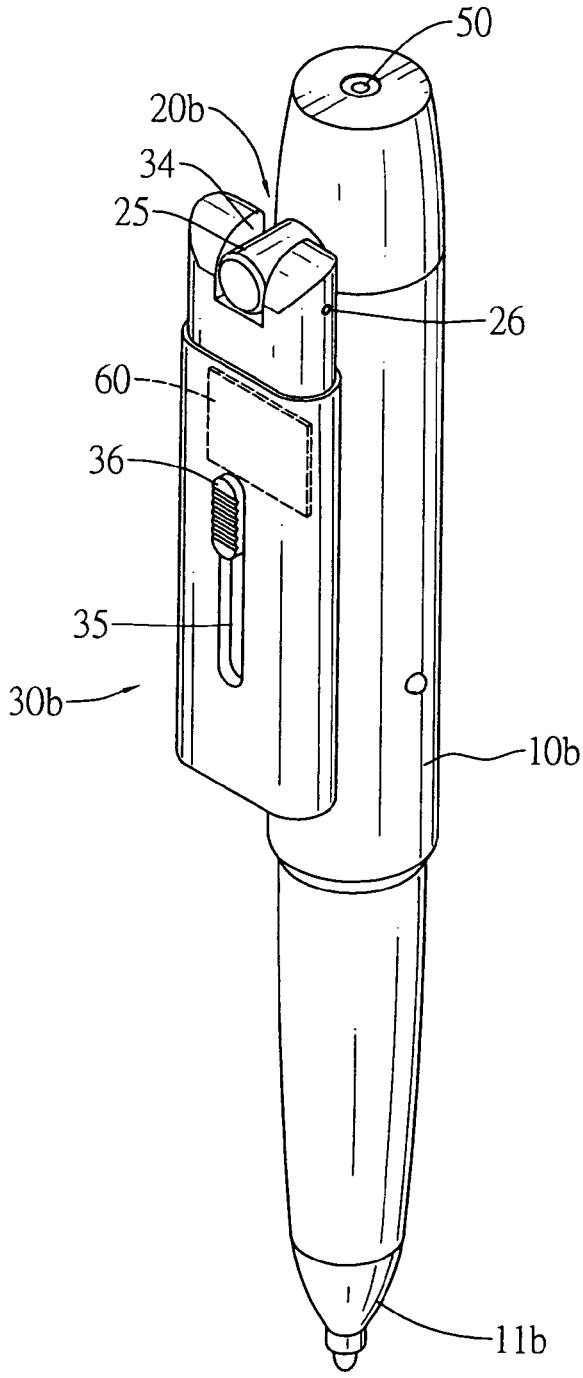
FIG. 6 is a perspective view of a third embodiment of the writing instrument in accordance with the present invention.

With further reference to FIG. 5, the connector (20*a*) on the second embodiment of the writing instrument is U-shaped and forms a mounting hole (24). The mounting hole (24) is formed longitudinally between the connector (20*a*) and the barrel (10*a*).

Figure 7:
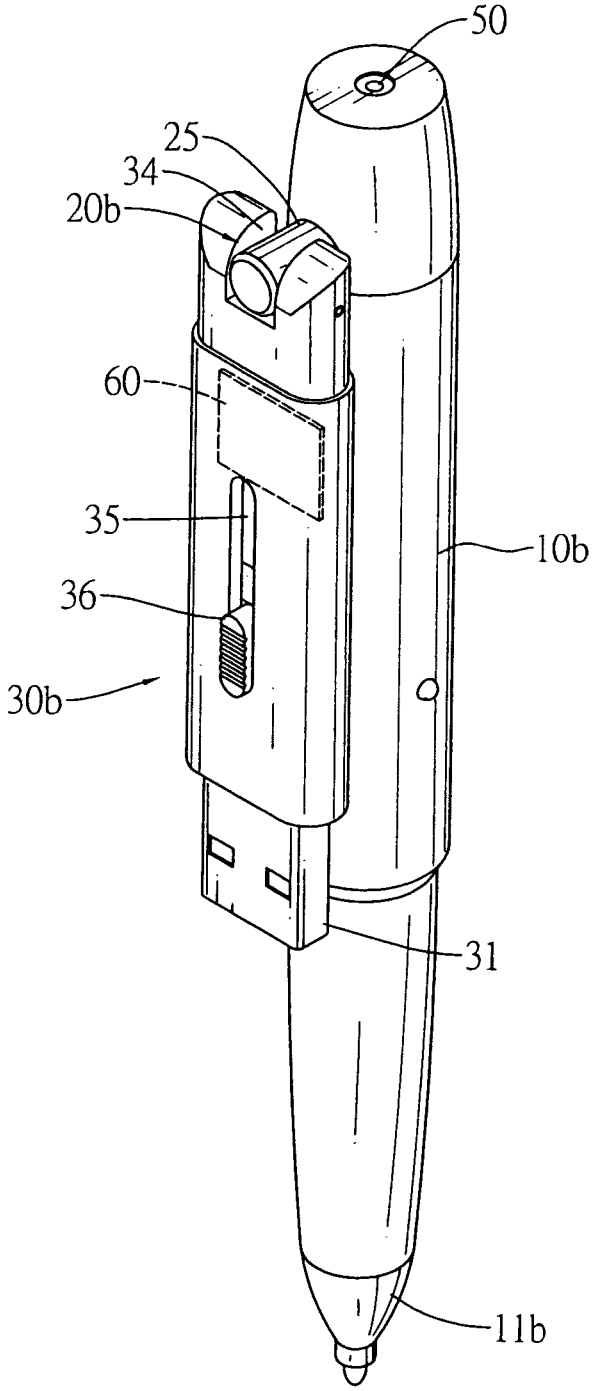
FIG. 7 is an operational perspective view of the writing instrument in FIG. 6 with a memory device extended from a clip.
Figure 8:
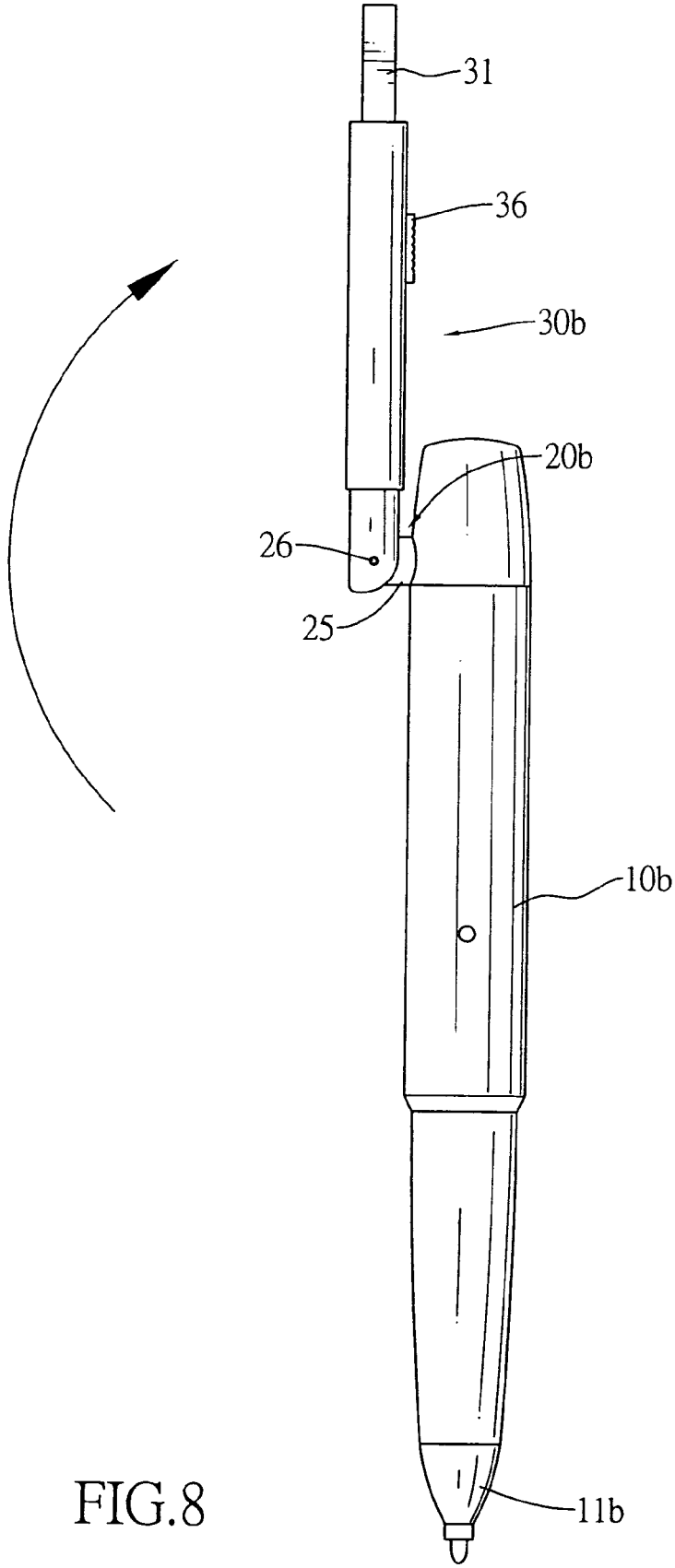
FIG. 8 is an operational side view of the writing instrument in FIG. 6 with the memory device extended and the clip pivoted.
Figure 9:
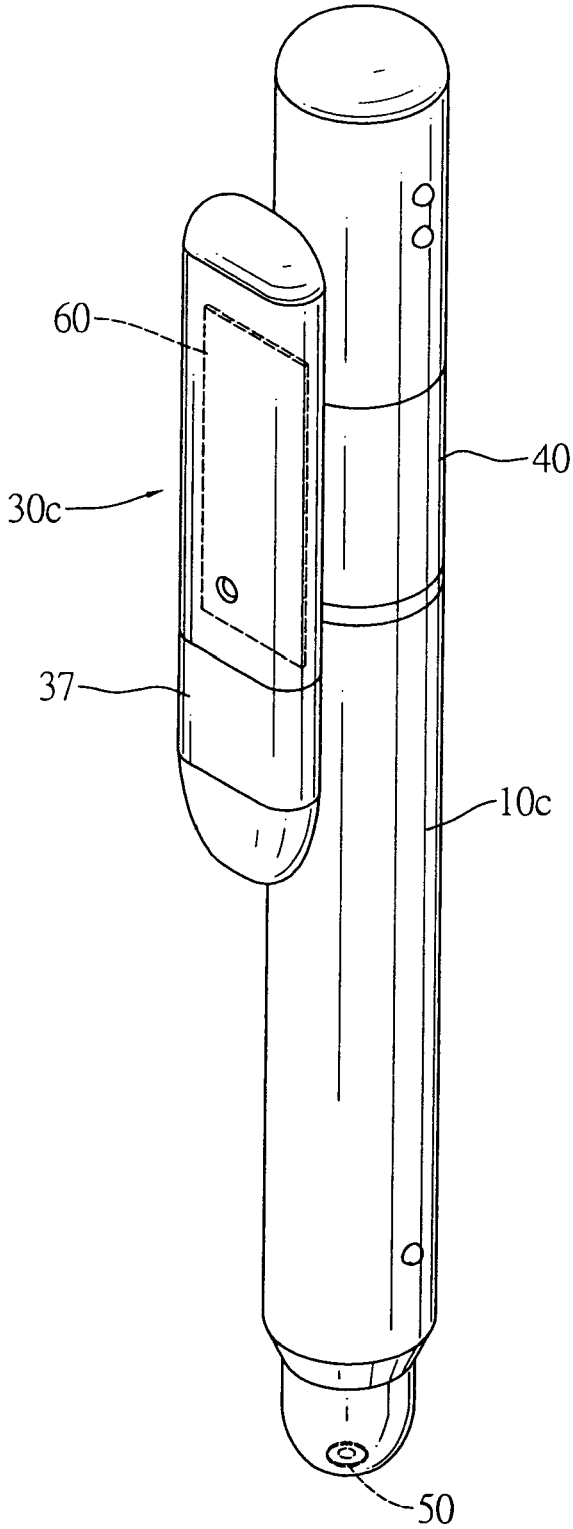
FIG. 9 is a perspective view of a fourth embodiment of the writing instrument in accordance with the present invention.

With further reference to FIG. 7, the connector (20*b*) on the third embodiment of the writing instrument comprises a mounting post (25) and a pivot (26). The mounting post (25) is attached to and protrudes radially out from the outer surface of the barrel (10*b*) and has a distal end and an outer annular surface. The pivot (26) protrudes from opposite sides of the outer annular surface near the distal end of the mounting post (25).

In a fourth embodiment of the writing instrument in accordance with the present invention, the connector (20*c*) is attached to and protrudes from the cover (40) and has a distal end.

Figure 14:
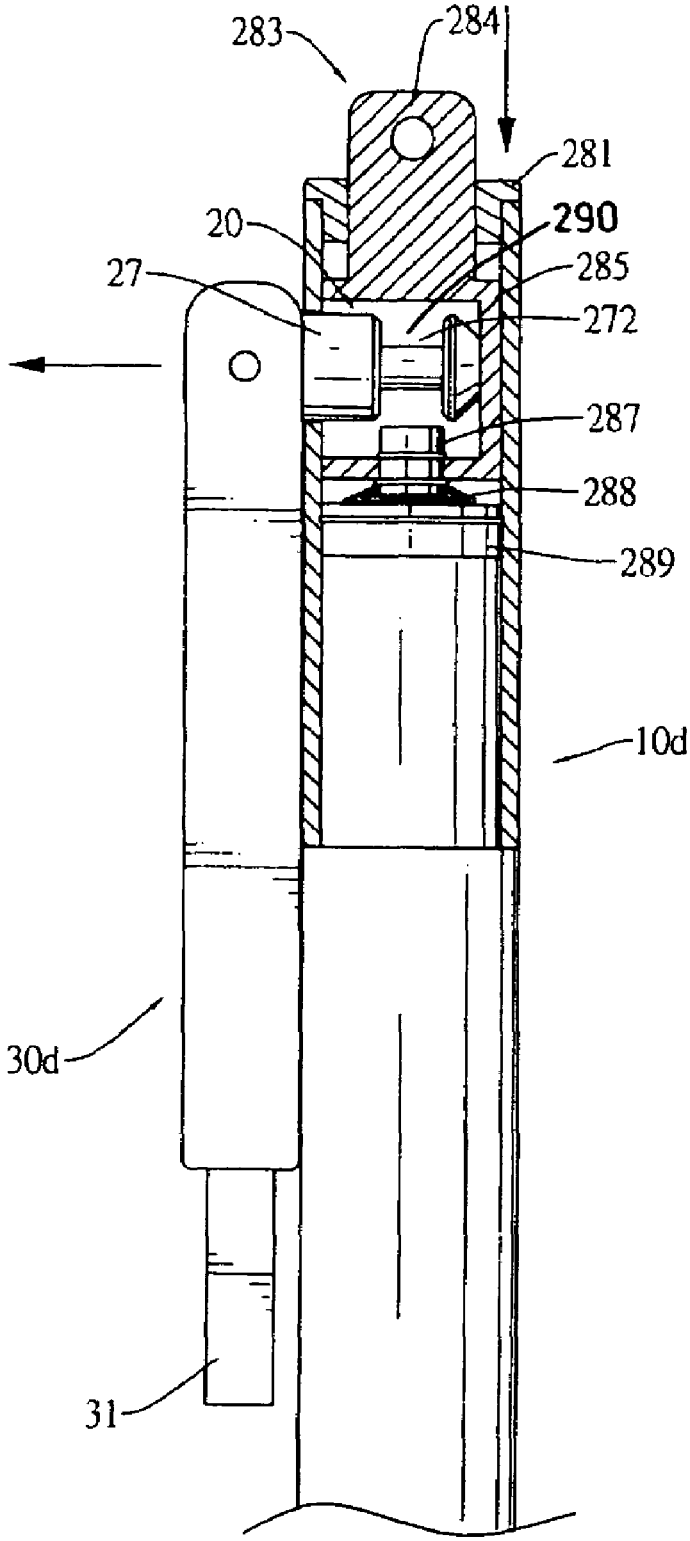
FIG. 14 is an operational side view in partial section of the writing instrument in FIG. 13.

In a fifth embodiment of the writing instrument in accordance with the present invention, the connector (20*d*) is attached detachably to the outer surface of the barrel (10*d*). With further reference to FIG. 12, the connector (20*d*) comprises a connecting shaft (27), a lock assembly (28) and a pivot (29). The connecting shaft (27) is selectively mounted through the through hole (12) and comprises a proximal end, a rear end, a pivot hole (271) and a circumference gap (272). The pivot hole (271) is defined near the rear end. The circumference gap (272) is defined near the proximal end. The lock assembly (28) is mounted in the barrel (10*d*) and comprises a cover (281), a button (283), a lock pin (287), a spring (288) and a fixed board (289). The cover (281) is securely mounted on the rear end of the barrel (10*d*) and comprises a center and a hole (282). The hole (282) is defined through the center of the cover (281). The button (283) is mounted in the barrel (10*d*), protrudes from the hole (282) and comprises a cylindrical body (285) and a press key (284). The cylindrical body (285) comprises a circumference, a bottom, a top, a rip or opening (290) and a hole (286). The rip is defined on the circumference. The hole (286) is formed through the bottom. The press key (284) protrudes from the hole (282) of the cover (281) and is mounted on the top of the cylindrical body (285). The lock pin (287) is a cylinder, is securely mounted through the hole of the cylindrical body (284) to slide with the cylindrical body (284) and protrudes into the circumference gap (272) to selectively fasten the connecting shaft (27). The spring (288) is mounted around the lock pin (287) to press against the cylindrical body (285). The fixed board (289) is securely mounted in the barrel (10*d*). The pivot (29) is mounted in the pivot hole (271). With further reference to FIG. 14, a user presses the press key (284) to move the cylindrical body (285). After the lock pin (287) moves down, the connecting shaft (27) is detached from the lock pin (287).

The clip (30, 30*a*, 30*b*, 30*c*, 30*d*) is attached to the connector (20, 20*a*, 20*b*, 20*c*, 20*d*) so the writing instrument can be clipped in a pocket by the clip (30, 30*a*, 30*b*, 30*c*, 30*d*) and has an outer surface, an inner surface, a distal end, a proximal end, a cavity, memory (60) and an input and output (I/O) interface (31). The cavity is formed longitudinally inside the clip (30, 30*a*, 30*b*, 30*c*, 30*d*) and communicates with one end of the clip (30, 30*a*, 30*b*, 30*c*, 30*d*). The memory (60) stores data, is mounted in the cavity and may be mounted slidably in the cavity. The (I/O) interface (31) is mounted in and protrudes from one end of the clip (30, 30*a*, 30*b*, 30*c*, 30*d*), is connected electronically to the memory (60), may retract slidably into the cavity and may be a USB plug.

The clip (30) on the first embodiment of the writing instrument further has multiple detents (32). The detents (32) are formed respectively in the outer surface and the inner surface near the proximal end, correspond to the protrusions (23) in the mounting recess (22) in the connector (20) and selectively attach to and hold the protrusions (23) so the clip (30) can attach to the connector (20) parallel to the barrel (10).

The clip (30*a*) on the second embodiment of the writing instrument further has a mounting tab (33). The mounting tab (33) is L-shaped and resilient, is formed on the inner surface near the proximal end, extends toward the distal end and is mounted detachably through the mounting hole (24) in the connector (20*a*).

The clip (30*b*) on the third embodiment of the writing instrument further has a mounting recess (34), a through slot (35) and a thumb tab (36). The mounting recess (34) is defined in the proximal end of the clip (30*b*) and is mounted pivotally on the mounting post (25). The through slot (35) is defined longitudinally through the outer surface. The thumb tab (36) is mounted slidably in and protrudes from the through slot (35) and is attached to the I/O interface (31) so the I/O interface (31) is retracted into or extended from the cavity by the thumb tab (36). A user pushes the thumb tab (36) to extend the I/O interface (31) and pivots the clip (30*b*) to plug the I/O interface (31) into an electronic device.

The clip (30*c*) on the fourth embodiment of the writing instrument further has a cap (37). The cap (37) selectively covers the I/O interface (31).

The clip (30*d*) on the fifth embodiment of the writing instrument further has a mounting recess (38). The mounting recess (38) is defined in the proximal end of the clip (30*d*) and is mounted pivotally on the pivot (29).

The laser pointer (50) may be mounted on the rear end of the barrel (10*b*, 10*c*) or on the proximal end of the clip (30*a*).

The writing instrument as described allows a person to write or store data with a single instrument that does not have a significantly larger volume than a conventional writing instrument. Consequently, the writing instrument is convenience and neat.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A writing instrument comprising
a barrel having
a front end;
a rear end;
an outer surface; and
a writing tip mounted on the front end;
a connector attached on the outer surface of the barrel; and
a clip being attached to the connector and having
an outer surface;
an inner surface;
a distal end;
a proximal end;
a cavity being formed longitudinally inside the clip and communicating with one end of the clip;
memory storing data and being mounted in the cavity; and
an input and output (I/O) interface being mounted in and protruding from one end of the clip and being connected electronically to the memory.

2. The writing instrument as claimed in claim 1, wherein
the connector comprises
a base attached securely to the outer surface of the barrel and having a bottom surface; and
a mounting recess defined in the bottom surface of the base and having
an inner surface; and
two protrusions formed on and protruding from the bottom surface flush with the inner surface of the mounting recess and parallel to each other; and
the clip has multiple detents formed respectively in the outer surface and the inner surface near the proximal end, corresponding to the protrusions in the mounting recess in the connector and selectively attaching to and holding the protrusions.

3. The writing instrument as claimed in claim 2, wherein the I/O interface is a USB plug.

4. The writing instrument as claimed in claim 3 further comprising a laser pointer mounted on the rear end of the barrel.

5. The writing instrument as claimed in claim 1, wherein
the connector is U-shaped and forms a mounting hole longitudinally between the connector and the barrel; and
the clip has a mounting tab being L-shaped and resilient, being formed on the inner surface near the proximal end, extending toward the distal end and being mounted detachably through the mounting hole.

6. The writing instrument as claimed in claim 5, wherein the I/O interface is a USB plug.

7. The writing instrument as claimed in claim 6 further comprising a laser pointer mounted on the rear end of the barrel.

8. The writing instrument as claimed in claim 1, wherein the connector comprises a mounting post attached to and protruding radially out from the outer surface of the barrel and having a distal end and an outer annular surface; and a pivot protruding from opposite sides of the outer annular surface near the distal end of the mounting post; and the clip has a mounting recess defined in the proximal end of the clip and mounted pivotally on the mounting post.

9. The writing instrument as claimed in claim 1 further comprising a laser pointer mounted on the proximal end of the clip.

10. The writing instrument as claimed in claim 9, wherein the clip has a through slot defined longitudinally in the outer surface of the clip; and a thumb tab mounted slidably in and protruding out of the through slot and being attached to the I/O interface.

11. The writing instrument as claimed in claim 10, wherein the I/O interface is a USB plug.

12. The writing instrument as claimed in claim 1, wherein the barrel has a through hole defined on the barrel adjacent to the rear end of the barrel;

the connector has a connecting shaft selectively mounted through the through hole and having a proximal end;

a rear end;

a pivot hole defined near the rear end; and a circumference gap defined near the proximal end;

a lock assembly mounted in the barrel and having a cover securely mounted on the rear end of the barrel and having a center; and a hole defined through the center of the cover;

a button mounted in the barrel, protruding from the hole of the cover and having a cylindrical body having a circumference;

a bottom;

atop;

an opening formed on the circumference; and a hole formed through the bottom; and a press key protruding from the hole of the cover and mounted on the top of the cylindrical body;

a lock pin being a cylinder, securely mounted through the hole of the cylindrical body to slide with the cylindrical body and protruding into the circumference gap to selectively fasten the connecting shaft;

a spring mounted around the lock pin; and a fixed board securely mounted in the barrel; and a pivot mounted in the pivot hole; and the clip has a mounting recess defined in the proximal end of the clip and mounted pivotally on the pivot.

13. The writing instrument as claimed in claim 12, wherein the I/O interface is a USB plug.

14. A writing instrument comprising a barrel having a front end;

a rear end;

an outer surface; and a writing tip mounted on the front end;

a cap selectively covering the writing tip and connecting detachably to the front end of the barrel;

a connector being attached to and protruding from the cap and having a distal end; and a clip being attached to the connector and having an outer surface;

an inner surface;

a distal end;

a proximal end;

a cavity being formed longitudinally inside the clip and communicating with one end of the clip; and a memory storing data and being mounted in the cavity; and an input and (I/O) output interface being mounted in and protruding from one end of the clip and being connected electronically to the memory.

15. The writing instrument as claimed in claim 14, wherein the clip further has a cap selectively covering the I/O interface.

16. The writing instrument as claimed in claim 15 further comprising a laser pointer mounted on the rear end of the barrel.

17. The writing instrument as claimed in claim 16, wherein the I/O interface is a USB plug.

* * * * *